US009738468B2

(12) United States Patent
Esaka

(10) Patent No.: US 9,738,468 B2
(45) Date of Patent: Aug. 22, 2017

(54) SHEET FEEDING APPARATUS AND IMAGE FORMING APPARATUS

(71) Applicant: CANON FINETECH INC., Misato-shi, Saitama (JP)

(72) Inventor: Yusuke Esaka, Ichikawa (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 15/013,030

(22) Filed: Feb. 2, 2016

(65) Prior Publication Data

US 2016/0244283 A1 Aug. 25, 2016

(30) Foreign Application Priority Data

Feb. 19, 2015 (JP) ..... 2015-030576

(51) Int. Cl.
*B65H 7/00* (2006.01)
*B65H 3/06* (2006.01)
*B65H 5/06* (2006.01)

(52) U.S. Cl.
CPC ..... *B65H 3/0669* (2013.01); *B65H 3/0607* (2013.01); *B65H 5/062* (2013.01); *B65H 7/00* (2013.01); *B65H 2403/421* (2013.01); *B65H 2403/724* (2013.01); *B65H 2403/82* (2013.01); *B65H 2404/1112* (2013.01); *B65H 2404/1113* (2013.01); *B65H 2511/212* (2013.01); *B65H 2513/108* (2013.01); *B65H 2513/53* (2013.01)

(58) Field of Classification Search
CPC ..... B65H 3/0669; B65H 2404/1112; B65H 2513/108; B65H 2403/82
See application file for complete search history.

(56) References Cited

U.S. PATENT DOCUMENTS 8,033,541 B2 * 10/2011 Akiyama ..... B41J 13/0018 271/10.03
8,328,180 B2 * 12/2012 Kwak ..... B65H 3/0669 271/10.13
8,783,676 B2 * 7/2014 Yamamoto ..... B65H 5/06 271/10.11

FOREIGN PATENT DOCUMENTS

| | | | |
|---|---|---|---|
| JP | 06-009079 | A | 1/1994 |
| JP | 2001-097601 | A | 4/2001 |
| JP | 2003-104573 | A | 4/2003 |
| JP | 2006-036439 | A | 2/2006 |
| JP | 2008-110835 | A | 5/2008 |

* cited by examiner

*Primary Examiner* — Jeremy R Severson
(74) *Attorney, Agent, or Firm* — Fitzpatrick, Cella, Harper & Scinto

(57) ABSTRACT

A sheet feeding apparatus, including: a stacking unit; a feed unit having a contact portion to be brought into contact with a sheet stacked on the stacking unit and a noncontact portion kept out of contact with the sheet, the feed unit being configured to feed the sheet in a contact state in which the contact portion is in contact with the sheet, and then turn into a noncontact state in which the noncontact portion faces the sheet so as to be kept out of contact with the sheet; a conveyance unit arranged downstream of the feed unit; and a drive unit configured to drive the conveyance unit at a first speed in the contact state and to drive the conveyance unit at a second speed higher than the first speed in the noncontact state.

6 Claims, 11 Drawing Sheets

V1: 134 mm/s (THE SAME SPEED AS PICKUP ROLLER)
V2: 214 mm/s
T1: TIME AT WHICH PICKUP ROLLER STARTS TO ROTATE
T2: TIME AT WHICH PICKUP ROLLER STARTS TO FEED SHEET
T3: TIME AT WHICH LEADING EDGE OF SHEET REACHES CONVEYANCE ROLLER
T4: TIME AT WHICH NONCONTACT PORTION OF PICKUP ROLLER FACES SHEET
T5: TIME AT WHICH PICKUP ROLLER STOPS ROTATING

SHEET FEEDING APPARATUS AND IMAGE FORMING APPARATUS

BACKGROUND OF THE INVENTION

Field of the Invention

The present invention relates to a sheet feeding apparatus configured to feed sheets, and to an image forming apparatus including the sheet feeding apparatus.

Description of the Related Art

Hitherto, in image forming apparatus such as a printer or a copying machine configured to form an image on a sheet, sheets stacked in a cassette are fed through use of a sheet feeding apparatus to form images on the fed sheets. In this case, in response to conveyance of the sheet to a predetermined position in a conveyance path, the sheet feeding apparatus separates pickup rollers from the sheet and switches a feed motor to a high speed mode to convey the sheet at higher speed with a roller located downstream of the pickup rollers, thus allowing intervals between the sheets to be reduced while increasing the printing speed (Japanese Patent Application Laid-Open No. 2008-110835).

In the related-art configuration, however, it is necessary to separate the pickup rollers from the sheet at a timing at which the sheet conveying speed is increased, thus causing a problem in that the apparatus configuration is complicated.

SUMMARY OF THE INVENTION

The present invention provides a sheet feeding apparatus which increases a sheet feed rate with a simple configuration, and also provides an image forming apparatus including the sheet feeding apparatus.

According to one embodiment of the present invention, there is provided a sheet feeding apparatus, comprising:

a stacking unit on which a sheet is to be stacked;

a feed unit comprising:

a contact portion to be brought into contact with the sheet stacked on the stacking unit; and noncontact portion kept out of contact with the sheet, the feed unit being configured to feed the sheet in a contact state in which the contact portion is in contact with the sheet, and then turn into a noncontact state in which the noncontact portion faces the sheet so as to be kept out of contact with the sheet;

a conveyance unit arranged downstream of the feed unit in a sheet feed direction and configured to convey the sheet fed by the feed unit; and a drive unit configured to drive the conveyance unit at a first conveying speed when the feed unit is in the contact state, and to drive the conveyance unit at a second conveying speed which is higher than the first conveying speed when the feed unit is in the noncontact state.

According to one embodiment of the present invention, there is provided an image forming apparatus, comprising:

a sheet feeding apparatus; and an image forming portion configured to form an image on a sheet fed by the sheet feeding apparatus, the sheet feeding apparatus comprising:

a stacking unit on which a sheet is to be stacked;

a feed unit comprising:

a contact portion to be brought into contact with the sheet stacked on the stacking unit; and a noncontact portion kept out of contact with the sheet, the feed unit being configured to feed the sheet in a contact state in which the contact portion is in contact with the sheet, and then turn into a noncontact state in which the noncontact portion faces the sheet to be kept out of contact with the sheet;

a conveyance unit arranged downstream of the feed unit in a sheet feed direction and configured to convey the sheet fed by the feed unit; and a drive unit configured to drive the conveyance unit at a first conveying speed when the feed unit is in the contact state, and to drive the conveyance unit at a second conveying speed which is higher than the first conveying speed when the feed unit is in the noncontact state.

Further features of the present invention will become apparent from the following description of exemplary embodiments with reference to the attached drawings.

DESCRIPTION OF THE EMBODIMENTS

A sheet feeding apparatus according to embodiments of the present invention and an image forming apparatus according to embodiments of the present invention including the sheet feeding apparatus will be described below with reference to the attached drawings.

(Image Forming Apparatus)

Figure 1:
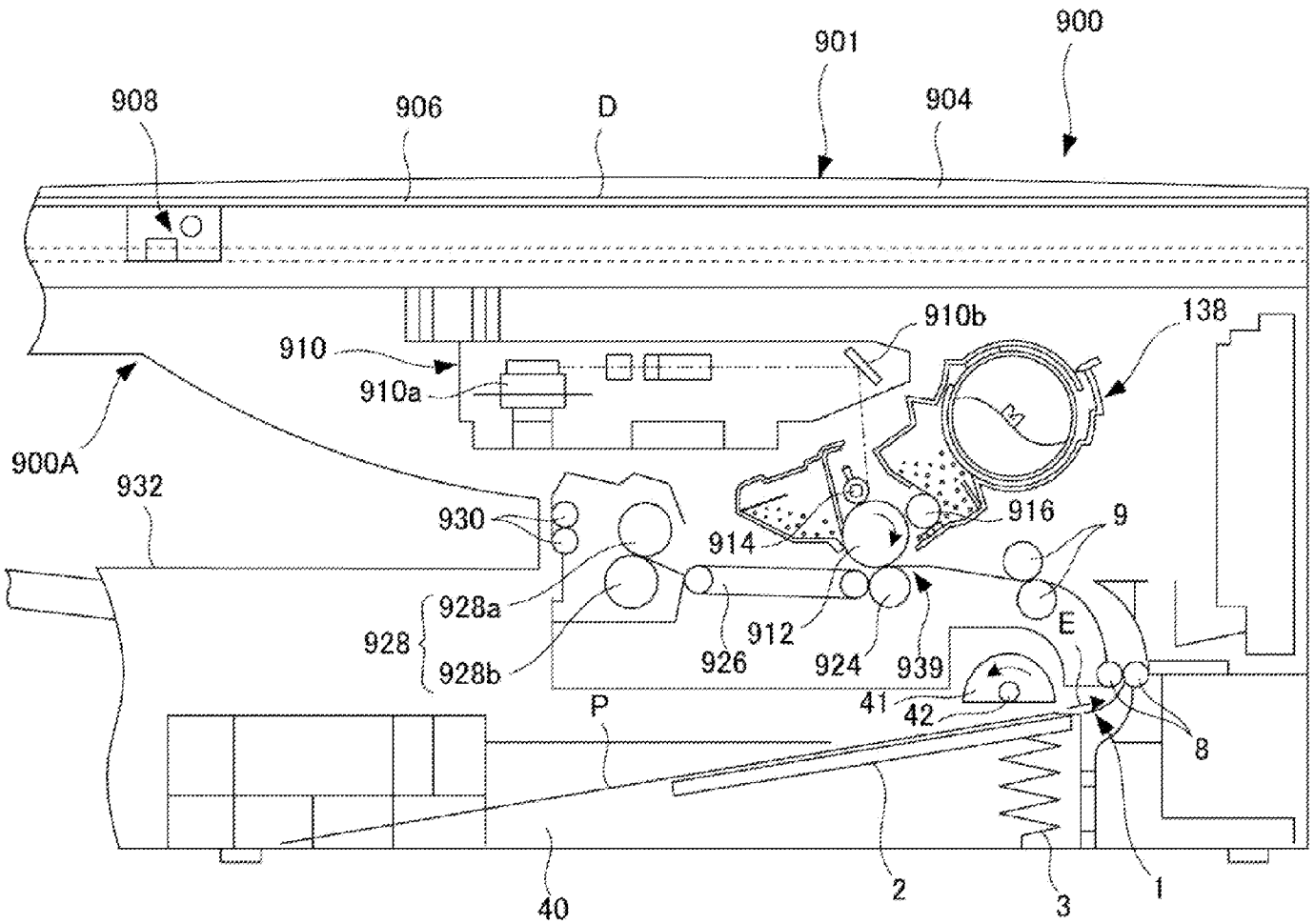
FIG. 1 is a schematic cross-sectional view of an image forming apparatus taken along a sheet feed direction according to a first embodiment.

FIG. 1 is a schematic cross-sectional view of an image forming apparatus 900 taken along a sheet feed direction according to an embodiment of the present invention. The image forming apparatus 900 includes an image reading apparatus 901, which is located in the upper part of an apparatus main body 900A, and is configured to read an original.

In the image reading apparatus 901, an original pressing plate 904 is opened by a user, and an original D is placed on an original glass plate 906 with an image side facing downward. Then, the original pressing plate 904 is closed by the user. The original pressing plate 904 presses the original D against the original glass plate 906. When an operation button on an operation panel (not shown) is pressed by the user, an image reading portion 908 is moved to the right direction in FIG. 1 to read the original D on the original glass plate 906. Finally, the image reading apparatus 901 converts an image of the read original to digital signals with a converter (not shown) and transmits the digital signals to a laser scanner 910.

The signals transmitted to the laser scanner 910 are converted to laser light, which is emitted to a photosensitive drum 912 via a scanner mirror 910*a* rotating at high speed and a reflection mirror 910*b*. The photosensitive drum 912 is uniformly charged by a charger 914 and an electrostatic latent image is formed on a portion irradiated with the laser light. The electrostatic latent image is developed into a visualized toner image with a toner developer supplied from a developing roller 916.

On the other hand, a sheet is fed from a sheet feed cassette 40 by semicircular pickup rollers 41 in a direction of the arrow E (sheet feed direction) and conveyed to the position between the photosensitive drum 912 and a transfer roller 924 by a separation-and-conveyance roller pair 8 and a registration roller pair 9. The transfer roller 924 transfers the toner image, which is formed on the photosensitive drum 912, onto the sheet being conveyed. The sheet having the toner image transferred thereonto is conveyed to a fixing unit 928 by a conveyance apparatus 926. The fixing unit 928 heats and pressurizes the sheet with a fixing roller 928*a* and a pressure roller 928*b* to fix the toner image onto the sheet. The sheet having the toner image fixed thereonto is delivered to a sheet delivery tray 932 with a sheet delivery roller pair 930.

In the above-mentioned configuration, the charger 914 and the photosensitive drum 912 are removably mounted in the apparatus main body 900A in the form of a process cartridge 138. The process cartridge 138 and the transfer roller 924 construct an image forming portion 939 configured to form an image on a sheet.

Figure 7:
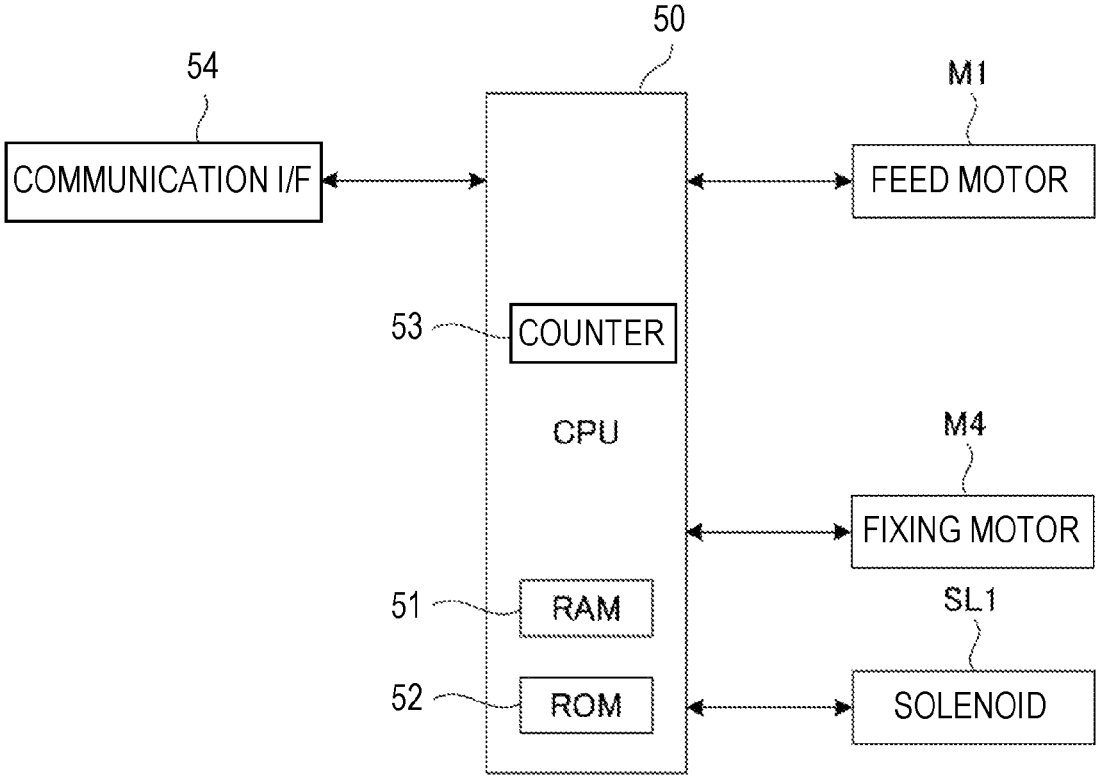
FIG. 7 is a block diagram of a control system configured to control the image forming apparatus.

The above-mentioned image forming apparatus 900 is configured to operate under the control of a CPU 50 illustrated in FIG. 7. FIG. 7 is a block diagram of a control system configured to control the image forming apparatus 900. The CPU 50 is configured to control a feed motor M1 to be described later, a fixing motor M4, and a solenoid SL1 to be described later. A RAM 51 is a work area of the CPU 50 and a temporary storage area of data. A firmware program for controlling the image forming apparatus and a boot program for controlling the firmware program are written in a ROM 52 and used by the CPU 50. A counter 53 is configured to count the number of revolutions of the feed motor M1. A communication I/F 54 is connected to an external computer so that image data is transferred via the communication I/F 54.

(Sheet Feeding Apparatus 1 According to First Embodiment)

Figure 2:
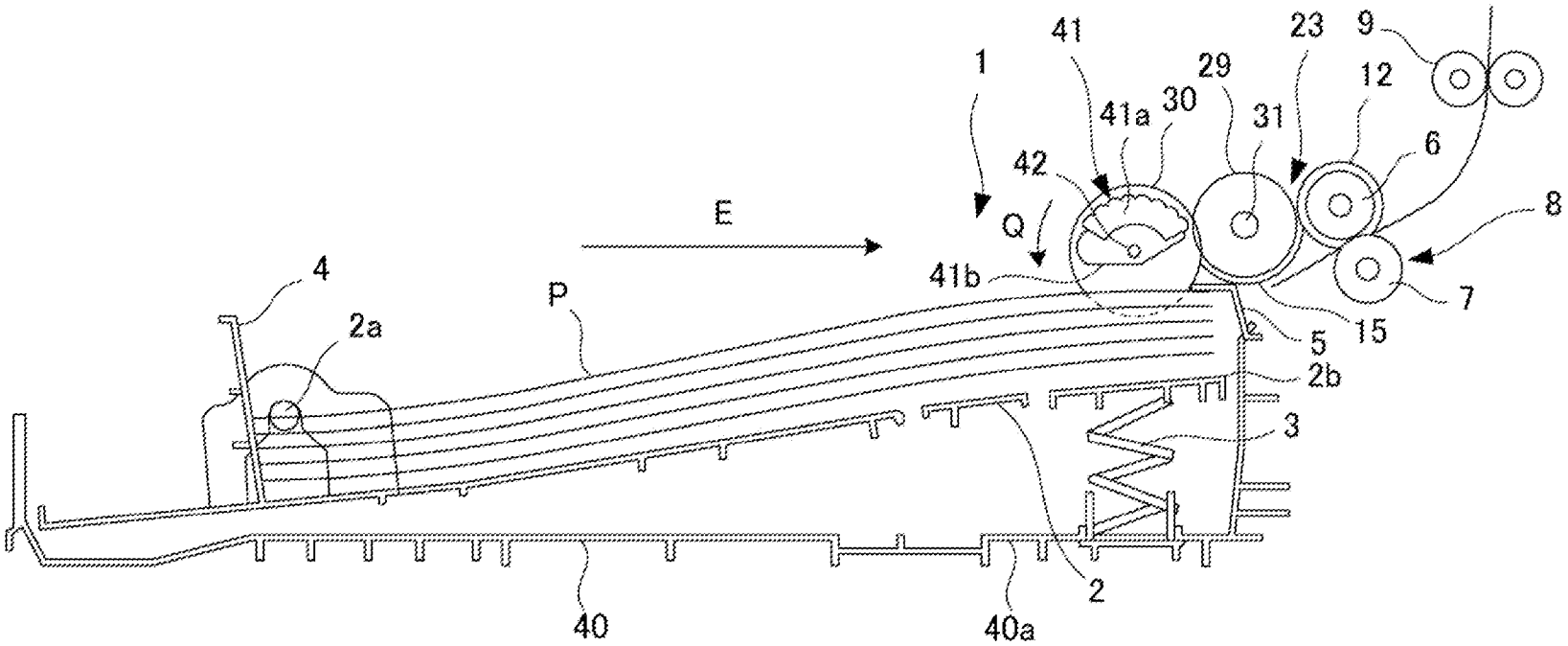
FIG. 2 is a cross-sectional view of a sheet feeding apparatus taken along the sheet feed direction according to the first embodiment.
Figure 3:
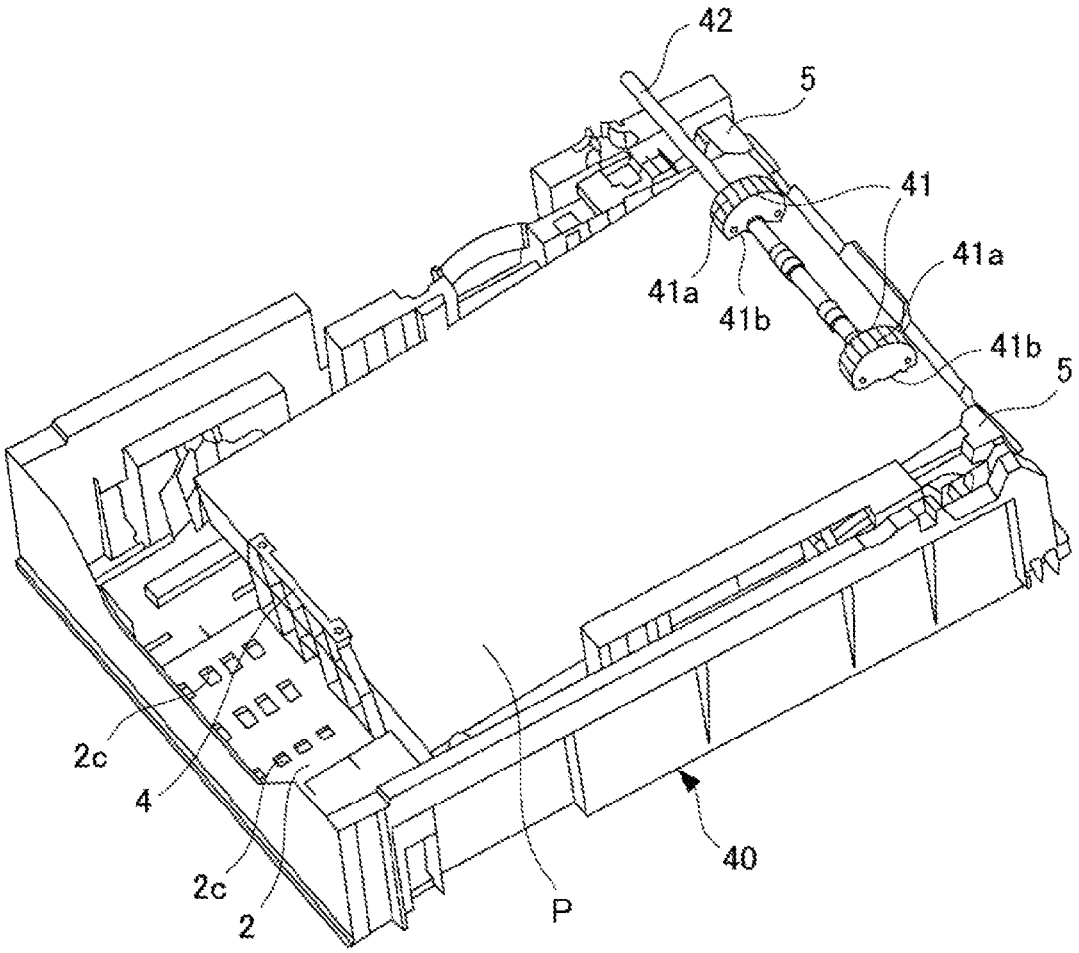
FIG. 3 is an external perspective view of a sheet feed cassette of FIG. 2.

FIG. 2 is a cross-sectional view of the sheet feeding apparatus 1 taken along the sheet feed direction according to the first embodiment. FIG. 3 is an external perspective view of the sheet feed cassette 40 of FIG. 2.

The sheet feeding apparatus 1 includes the sheet feed cassette 40, the semicircular pickup rollers 41, the separation-and-conveyance roller pair 8, and a drive portion 23. The sheet feed direction refers to a direction of the arrow E in FIG. 1 and FIG. 2. The expression "upstream in the sheet feed direction" refers to a left side in the direction of the arrow E and a trailing edge side of the sheet. The expression "downstream in the sheet feed direction" refers to a right side in the direction of the arrow E and a leading edge side of the sheet.

The sheet feed cassette 40 in the shape of a box for use as a stacking unit configured to stack sheets thereon includes a loading plate 2 configured to load sheets P by the user. The loading plate 2 is rotatably mounted on a fulcrum 2*a* of rotation formed upstream of the sheet feed cassette 40 in the sheet feed direction E so that a distal end portion 2*b* of the loading plate 2 on the downstream side in the sheet feed direction is moved up and down. A loading plate pressing spring 3 is arranged between a bottom plate 40*a* of the sheet feed cassette 40 and the distal end portion 2*b* of the loading plate 2. The loading plate pressing spring 3 is configured to press up the distal end portion 2*b* of the loading plate 2. A compression coil spring is used for the loading plate pressing spring 3 but a leaf spring or rubber may be used instead. A trailing edge regulating plate 4 is removably mounted on the loading plate 2. The mounting position of the trailing edge regulating plate 4 can be changed in accordance with the size of the sheet P by selecting suitable ones of a plurality of holes 2*c* formed in the loading plate 2 and inserting the trailing edge regulating plate 4 therein. Separation claws 5 configured to regulate the upper surface of the stacked sheet P are arranged at both upper corners of a downstream end portion of the sheet feed cassette 40, respectively. The separation claws 5 are arranged to allow sheets to be fed from the sheet feed cassette 40 one by one.

The semicircular pickup rollers 41 serving as a feed unit, that is, rotary members are rotatably arranged in the apparatus main body 900A so as to face the downstream end portion of the sheet feed cassette 40 in the sheet feed direction. Each pickup roller 41 includes, on an outer periphery in a rotation direction thereof, a semicircular contact portion 41*a* which is brought into contact with a sheet stacked on the sheet feed cassette 40 and a flat noncontact portion 41*b* which is not brought into contact with the sheet. The pickup rollers 41 are constructed so that the contact portion 41*a* is brought into contact with the uppermost sheet among the sheets stacked on the loading plate 2 to feed the uppermost sheet.

The separation-and-conveyance roller pair 8 serving as a conveyance unit, that is, a conveyance roller pair is arranged downstream of the pickup rollers 41 in the sheet feed direction. The separation-and-conveyance roller pair 8 includes a conveyance roller 6 and a separation roller 7, which are brought into press contact with each other. The conveyance roller 6 and the separation roller 7 are configured to convey a sheet by rotating while nipping the sheet therebetween. In the separation-and-conveyance roller pair 8, when sheets fed from the sheet feed cassette 40 by the pickup rollers 41 are stacked on one another, the lower separation roller 7 is configured to apply a load to resist conveyance of the lower sheet of the sheets stacked on one another, and the upper conveyance roller 6 is configured to convey one upper sheet. The sheets can be also separated by the separation claws 5 arranged on the sheet feed cassette 40 so as to be fed one by one, and hence a roller pair configured to convey the sheet may be simply arranged instead of the separation-and-conveyance roller pair 8.

Figure 4:
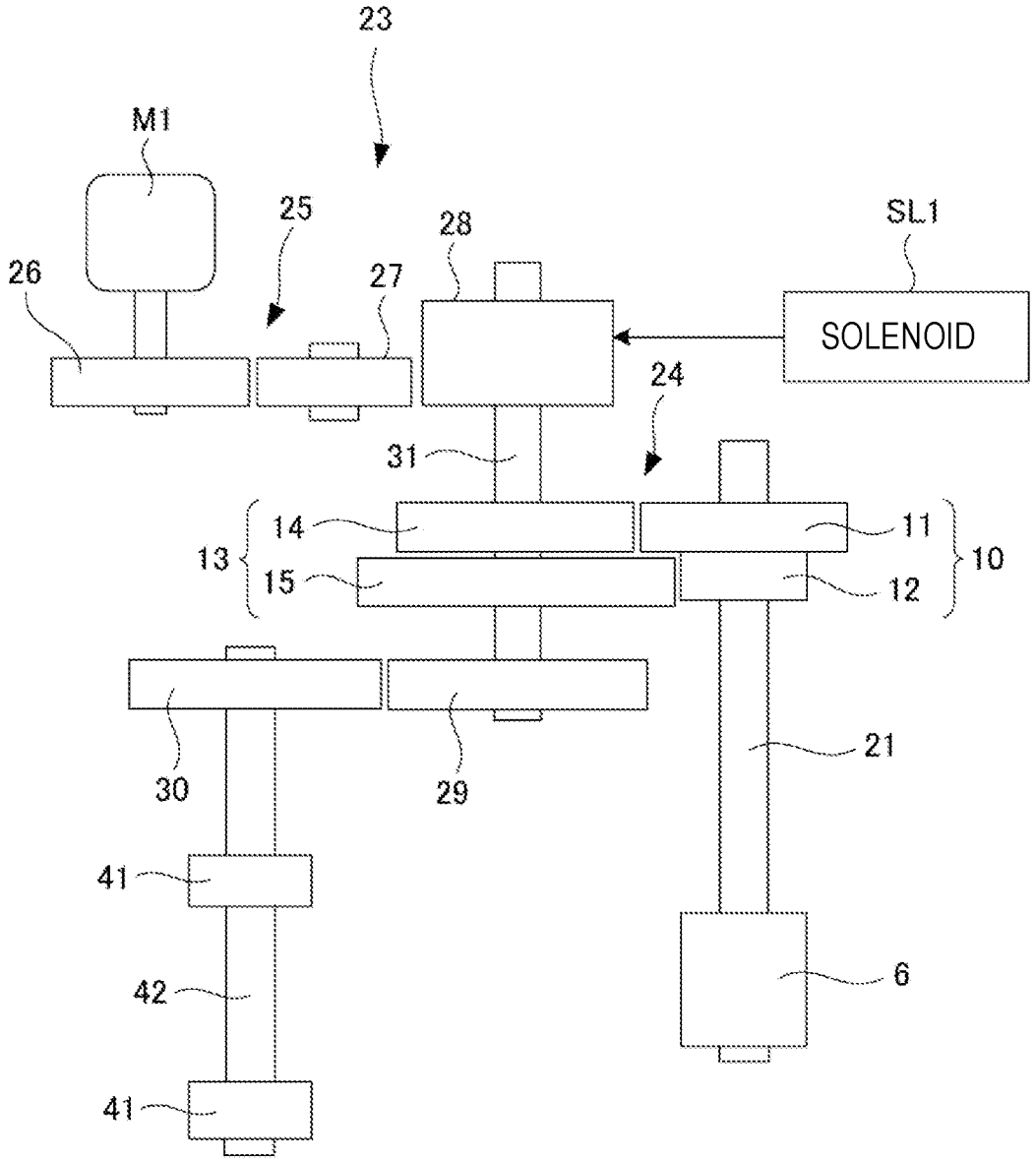
FIG. 4 is a view for illustrating a drive portion of the sheet feeding apparatus.

Next, the drive portion 23 configured to increase the sheet feed rate of the sheet feeding apparatus 1 will be described. FIG. 4 is a view for illustrating the drive portion 23 of the sheet feeding apparatus 1. The drive portion 23 serving as a drive unit is configured to drive the shared feed motor M1 to rotate the semicircular pickup rollers 41 and the conveyance roller 6 of the separation-and-conveyance roller pair 8.

The drive portion 23 includes the feed motor M1 serving as a drive source configured to rotate the pickup rollers 41 and the conveyance roller 6, and a rotation transmission mechanism 24 arranged between the feed motor M1 and the conveyance roller 6 so that the rotational driving force of the feed motor M1 is transmitted (transmittable) to the conveyance roller 6. The drive portion 23 further includes a gear train 25 configured to transmit the rotation of the feed motor M1 to the pickup rollers 41, and a solenoid SL1.

The gear train 25 includes a driving gear 26 arranged at the feed motor M1, a first intermediate gear 27, a second intermediate gear 28, a third intermediate gear 29, and a driven gear 30 arranged at a rotary shaft 42 of the pickup rollers 41. The first intermediate gear 27 is meshed with the driving gear 26 and the second intermediate gear 28. The second intermediate gear 28 and the third intermediate gear 29 are arranged integrally with a shared rotary shaft 31. The rotary shaft 31 is rotatably arranged in the apparatus main body 900A. Therefore, the gear train 25 is configured to transmit the rotational force of the feed motor M1 to the rotary shaft 42 via the driving gear 26, the first intermediate gear 27, the second intermediate gear 28, the rotary shaft 31, the third intermediate gear 29, and the driven gear 30, to thereby rotate the pickup rollers 41.

The rotation transmission mechanism 24 includes the driving gear 26 arranged at the feed motor M1, the first intermediate gear 27, the second intermediate gear 28, a small diameter sector gear 14, a large diameter sector gear 15, a large diameter gear 11, and a small diameter gear 12. The second intermediate gear 28 as well as the small diameter sector gear 14 and the large diameter sector gear 15 serving as conveyance control gears 13 is arranged integrally with the shared rotary shaft 31. The large diameter gear 11 and the small diameter gear 12 serving as conveyance driving stepped gears 10 are arranged integrally with a rotary shaft 21 of the conveyance roller 6. The small diameter sector gear 14 is configured to mesh with the large diameter gear 11. The large diameter sector gear 15 is configured to mesh with the small diameter gear 12.

Figure 5A:
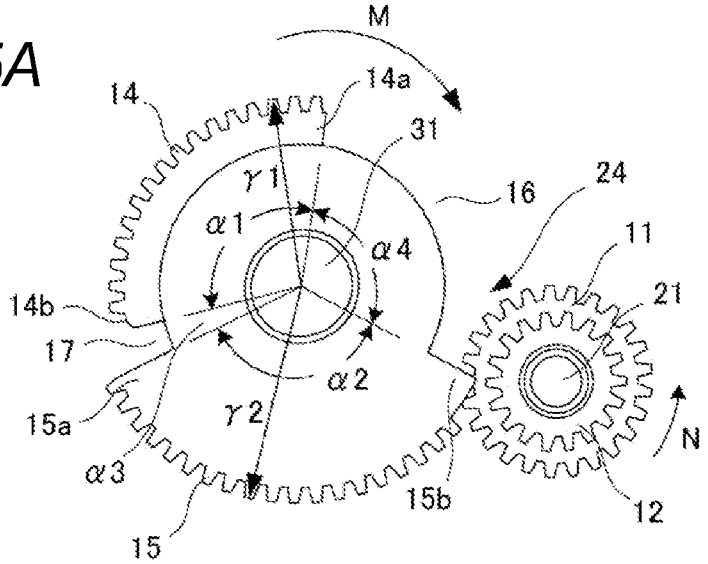
FIG. 5A, FIG. 5B, and FIG. 5C are explanatory views for illustrating an operation of a rotation transmission mechanism in the drive portion of FIG. 4.

In FIG. 5A to be described later, a radius $\gamma 1$ and a central angle $\alpha 1$ of the small diameter sector gear 14 are set to be smaller than a radius $\gamma 2$ and a central angle $\alpha 2$ of the large diameter sector gear 15, respectively ($\gamma 1<\gamma 2$, $\alpha 1<\alpha 2$). A central angle $\alpha 4$ formed between a stop end portion 15*b* of the large diameter sector gear 15 in a rotational direction M and a start end portion 14*a* of the small diameter sector gear 14 in the rotational direction M is set to be larger than a central angle $\alpha 3$ formed between a start end portion 15*a* of the large diameter sector gear 15 in the rotational direction M and a stop end portion 14*b* of the small diameter sector gear 14 in the rotational direction M. In other words, a relationship of $\alpha 4>\alpha 3$ is set. Therefore, a toothless portion 16 between the stop end portion 15*b* of the large diameter sector gear 15 and the start end portion 14*a* of the small diameter sector gear 14 is set to be wider than a toothless portion 17 between the start end portion 15*a* of the large diameter sector gear 15 and the stop end portion 14*b* of the small diameter sector gear 14.

The solenoid SL1 is configured to operate the second intermediate gear 28 so that the rotation of the feed motor M1 rotating at a constant speed causes the small diameter sector gear 14 and the large diameter sector gear 15 to make only one revolution.

Next, an operation of the sheet feeding apparatus 1 will be described based on the above-mentioned configuration with reference to FIG. 2 to FIG. 8.

Figure 5B:
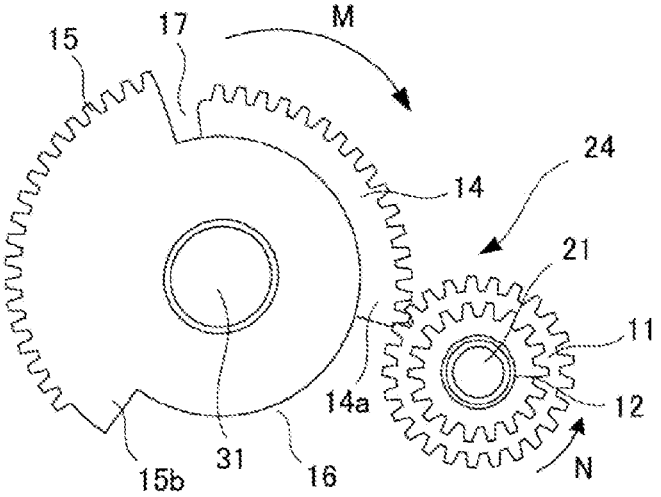
Figure 5C:
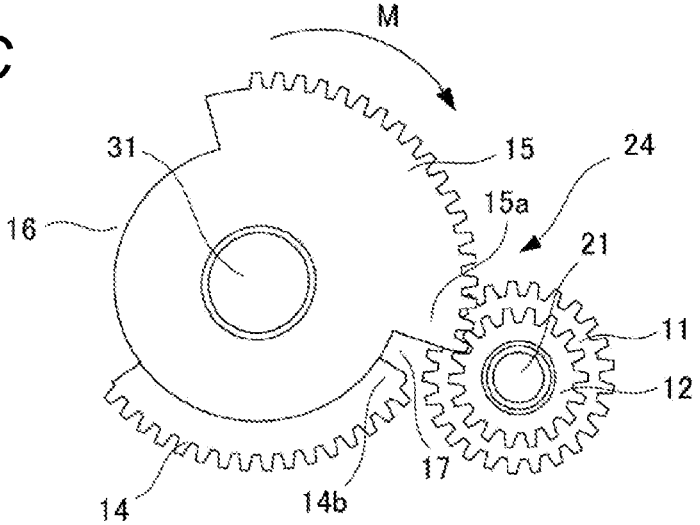
Figure 6A:
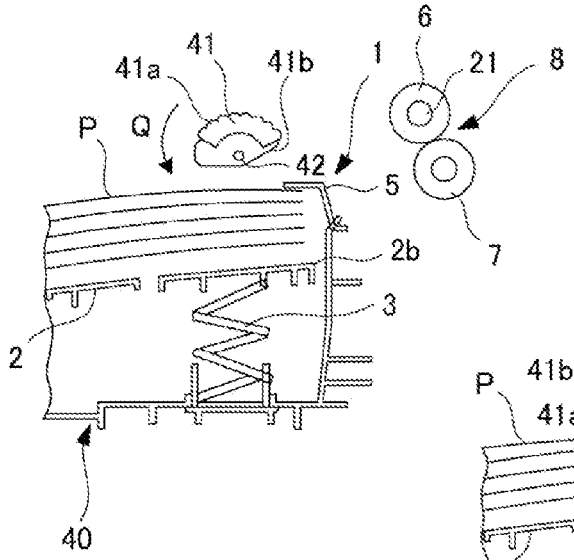
FIG. 6A, FIG. 6B, FIG. 6C, and FIG. 6D are explanatory views for illustrating a sheet feeding operation in the sheet feeding apparatus of FIG. 2.
Figure 6B:
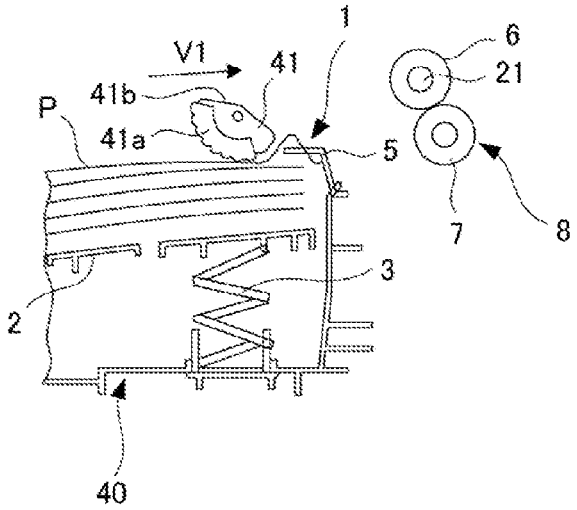
Figure 6C:
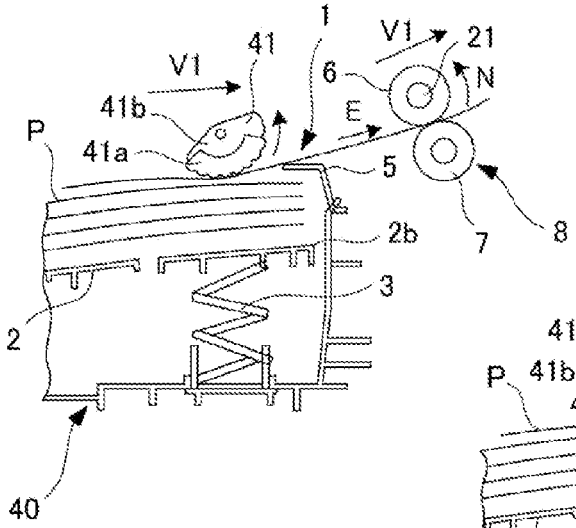
Figure 6D:
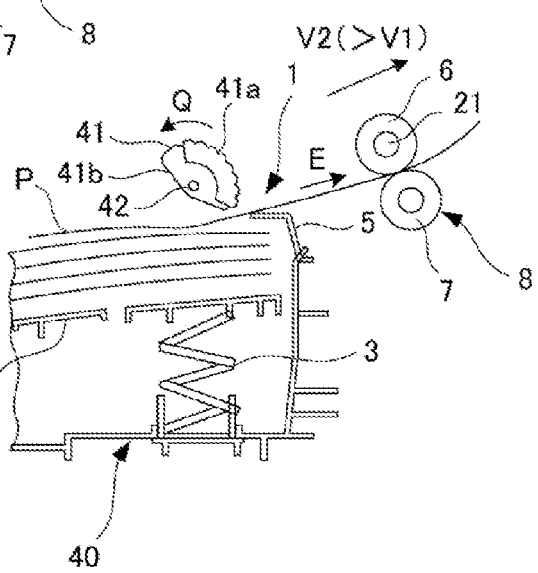
Figure 8:
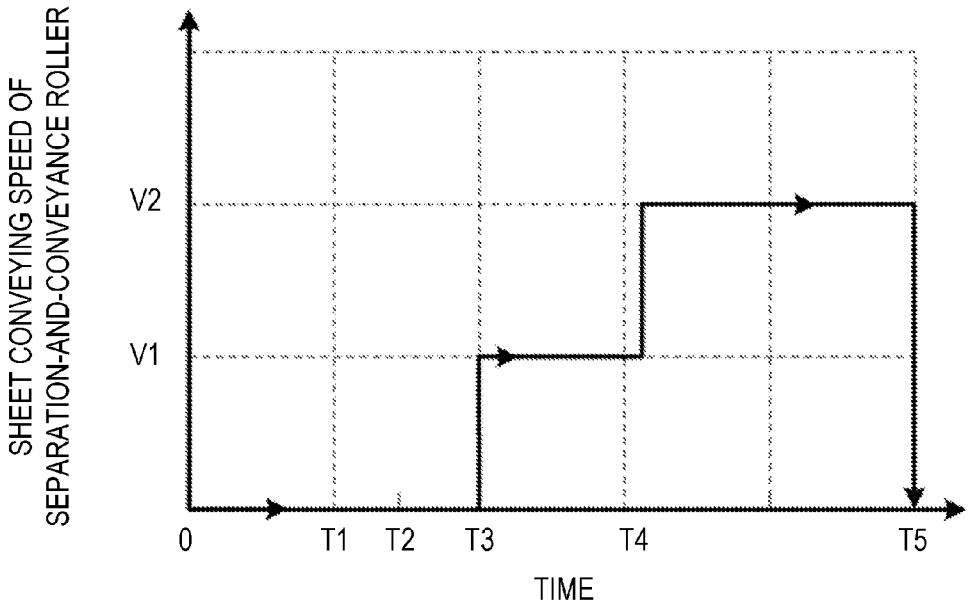
FIG. 8 is a graph for showing a relationship between a sheet conveying speed of pickup rollers and a sheet conveying speed of a separation-and-conveyance roller pair.

FIG. 5A, FIG. 5B, and FIG. 5C are explanatory views for illustrating an operation of the rotation transmission mechanism 24 in the drive portion 23 of FIG. 4. FIG. 5A is a view for illustrating an initial position of each gear immediately after the large diameter sector gear 15 is unmeshed from the small diameter gear 12 in a state in which the small diameter sector gear 14 and the large diameter sector gear 15 rotate in the direction of the arrow M, whereas the large diameter gear 11 and the small diameter gear 12 rotate in a direction of the arrow N. FIG. 5B is a view for illustrating a state in which the start end portion 14*a* of the small diameter sector gear 14 starts to mesh with the large diameter gear 11 to rotate the large diameter gear 11 and the rotary shaft 21 so that the conveyance roller 6 of the separation-and-conveyance roller pair 8 starts to rotate. FIG. 5C is a view for illustrating a state in which the small diameter sector gear 14 is separated from the large diameter gear 11 and the large diameter sector gear 15 starts to mesh with the small diameter gear 12. FIG. 6A, FIG. 6B, FIG. 6C, and FIG. 6D are explanatory views for illustrating an operation in the sheet feeding apparatus 1 of FIG. 2. FIG. 6A is a view for illustrating an initial state. FIG. 6B is a view for illustrating a state in which a sheet feeding operation was started. FIG. 6C is a view for illustrating a state in which a sheet is conveyed by the pickup rollers 41 and the separation-and-conveyance roller pair 8. FIG. 6D is a view for illustrating a state in which the sheet is conveyed by the separation-and-conveyance roller pair 8. FIG. 7 is a schematic control block diagram for illustrating the control of the image forming apparatus. FIG. 8 is a graph for showing a relationship between the sheet conveying speed of the pickup rollers 41 and the sheet conveying speed of the separation-and-conveyance roller pair 8.

The CPU 50 is configured to rotate the feed motor M1. However, the CPU 50 does not turn on the solenoid SL1 of FIG. 4. Therefore, even when the driving gear 26, the first intermediate gear 27, and the second intermediate gear 28 rotate, the rotation of the second intermediate gear 28 is not transmitted to the rotary shaft 31 so that the pickup rollers 41 and the conveyance roller 6 do not rotate. Accordingly, as illustrated in FIG. 6A, the semicircular pickup rollers 41 stop rotating in a state in which the noncontact portions 41*b* face the sheet P. In this state, the loading plate pressing spring 3 presses up the loading plate 2 to press up the sheet P loaded on the loading plate 2. Then, the separation claws 5 (FIG. 3) arranged at both corners at the downstream end portion of the sheet feed cassette 40 in the sheet feed direction receive both leading edge corners of the uppermost sheet. Moreover, as illustrated in FIG. 5A, the stop end portion 15*b* of the large diameter sector gear 15 faces the small diameter gear 12, and the large diameter sector gear 15 does not mesh with the small diameter gear 12. Therefore, the conveyance roller 6 stops rotating.

In this state, the CPU 50 turns on the solenoid SL1 for a time period of T1 seconds (FIG. 8). Then, the second intermediate gear 28 is rotated integrally with the rotary shaft 31, and the rotational force of the feed motor M1 is transmitted to the rotary shaft 42 via the driving gear 26, the first intermediate gear 27, the second intermediate gear 28, the rotary shaft 31, the third intermediate gear 29, and the driven gear 30. Consequently, the pickup rollers 41 rotate from the state of FIG. 6A in a direction of the arrow Q as in FIG. 6B. A DC motor or a stepping motor is used for the feed motor M1.

On the other hand, the rotation of the rotary shaft 31 causes the small diameter sector gear 14 and the large diameter sector gear 15 to integrally rotate from the state of FIG. 5A in the direction of the arrow M. Even when the small diameter sector gear 14 and the large diameter sector gear 15 rotate in the direction of the arrow M, the rotational force is not transmitted to the large diameter gear 11 and the small diameter gear 12 because the toothless portion 16 faces the large diameter gear 11 and the small diameter gear 12. Accordingly, although the small diameter sector gear 14 and the large diameter sector gear 15 rotate, the conveyance roller 6 does not rotate.

The conveyance roller 6 does not rotate as described above but the pickup rollers 41 rotate. Then, as illustrated in FIG. 6B, the pickup rollers 41 are brought into contact with the uppermost sheet P at the contact portion 41*a* to apply a feed force in a direction in which the uppermost sheet is fed from the sheet feed cassette 40 (sheet feed direction E). The uppermost sheet is pressed to be fed out from the sheet feed cassette 40. However, both corners at the leading edge of the sheet are caught in the separation claws 5. Therefore, the leading edge portion of the sheet P is bent in a convex shape, as illustrated in FIG. 6B.

The feed motor M1 continues to rotate, and hence the pickup rollers 41 still apply the feed force to the uppermost sheet. The sheet which is bent to some extent in a convex shape is separated from the separation claws 5 to return to the straight state. The uppermost sheet is separated from a sheet immediately under the uppermost sheet and starts to be fed from the sheet feed cassette 40. In FIG. 8, a time period T2 has elapsed since the feed motor M1 starts to rotate.

Before the leading edge of the sheet fed from the sheet feed cassette 40 by the pickup rollers 41 reaches the separation-and-conveyance roller pair 8 (FIG. 8, time T3), the start end portion 14*a* of the small diameter sector gear 14 starts to mesh with the large diameter gear 11, as illustrated in FIG. 5B. The large diameter gear 11 and the rotary shaft 21 rotate to start the rotation of the conveyance roller 6 of the separation-and-conveyance roller pair 8. Then, as illustrated in FIG. 6C, the sheet is fed into the separation-and-conveyance roller pair 8 by the pickup rollers 41 to be nipped by the separation-and-conveyance roller pair 8. The pickup rollers 41 and the separation-and-conveyance roller pair 8 convey the sheet at the same sheet conveying speed (constant speed) V1. The sheet conveying speed of the pickup rollers 41 is the same as that of the separation-and-conveyance roller pair 8, and hence the sheet is conveyed without causing slack or being pulled and torn.

Then, as illustrated in FIG. 6D, the pickup rollers 41 which have continued to rotate in the direction of the arrow Q start to face the sheet at the noncontact portions 41*b* to be separated from the sheet which the pickup rollers 41 have fed from the sheet feed cassette 40 until then (FIG. 8, time T4). Then, as illustrated in FIG. 5C, the small diameter sector gear 14 is separated from the large diameter gear 11, and the large diameter sector gear 15 meshes with the small diameter gear 12. The rotation speed of the conveyance roller 6 is increased to increase the sheet conveying speed of the separation-and-conveyance roller pair 8 from V1 to V2 (V2>V1). The noncontact portions 41*b* of the pickup rollers 41 face the sheet in this state, and hence the sheet is conveyed at the sheet conveying speed V2 without being subjected to the conveyance resistance of the pickup rollers 41.

However, when the sheet conveying speed of the separation-and-conveyance roller pair 8 is increased from V1 to V2 (V2>V1) in a state in which the sheet is conveyed while being held in contact with the pickup rollers 41 and the separation-and-conveyance roller pair 8, the pickup rollers 41 and the separation-and-conveyance roller pair 8 may pull the sheet from both sides. Then, when the small diameter sector gear 14 is separated from the large diameter gear 11 and the large diameter sector gear 15 meshes with the small diameter gear 12 in FIG. 5C, the large diameter gear 11 and the small diameter gear 12 are unmeshed by the toothless portion 17 to be brought into a rotatable state. Even if the pickup rollers 41 convey the sheet in the above-mentioned state, the separation-and-conveyance roller pair 8 does not convey the sheet, and hence the sheet can be prevented from being pulled from both sides.

In addition, at the beginning of conveyance of the sheet by the separation-and-conveyance roller pair 8 as illustrated in FIG. 6D, the sheet may be conveyed to the separation-and-conveyance roller pair 8 together with an underlying sheet without being separated by the separation claws 5. In such a case, with the load applied by the separation roller 7, the separation-and-conveyance roller pair 8 separates the underlying sheet to convey only the uppermost sheet to the downstream registration roller pair 9.

The feed motor M1 continues to rotate. Therefore, the pickup rollers 41 rotate from the state of FIG. 6D to the state of FIG. 6A, and the large diameter sector gear 15 continues to mesh with the small diameter gear 12 to rotate from the state of FIG. 5C to the state of FIG. 5A. The conveyance of the first sheet is thus completed (FIG. 8, time T5). Whether or not the conveyance of the first sheet is completed is determined by the CPU 50 based on the number of revolutions of the feed motor M1. When there is a sheet to be fed in succession, the CPU 50 operates the solenoid SL1 again to transmit the rotation of the feed motor M1 to the pickup rollers 41 and the separation-and-conveyance roller pair 8. When there is no sheet to be fed in succession, the rotation of the feed motor M1 is stopped. The pickup rollers 41 stop under a state in which the noncontact portions 41*b* face the sheet. In other words, each pickup roller 41 stops after being driven to rotate from a pickup position (contact position) at which the contact portion 41*a* is brought into contact with a sheet on the sheet feed cassette 40 to feed the sheet to a noncontact position in which the noncontact portion 41*b* faces the sheet on the sheet feed cassette to be kept out of contact with the sheet.

As described above, in the sheet feeding apparatus 1 according to the first embodiment, the sheet conveying speed of the separation-and-conveyance roller pair 8 can be increased by the rotation transmission mechanism 24 while the noncontact portions 41*b* of the pickup rollers 41 face the sheet. Therefore, even when the sheet conveying speed of the separation-and-conveyance roller pair 8 is increased from V1 to V2, the sheet feeding apparatus 1 can prevent the pickup rollers 41 and the separation-and-conveyance roller pair 8 from being damaged while sheets neither have conveyance failure nor are pulled from both sides. The sheet feed rate can be prevented from being reduced due to damage to the pickup rollers 41 and the separation-and-conveyance roller pair 8.

Except during the sheet feed, the sheet feeding apparatus 1 can keep the state in which the noncontact portions 41*b* of the pickup rollers 41 are not in contact with the sheet, and hence it is not necessary to separately arrange a mechanism configured to separate the pickup rollers 41 when the sheet feed cassette 40 is pulled out from the apparatus main body. Moreover, the loading plate 2 configured to place sheets thereon is pressed up by the loading plate pressing spring 3 so that the pickup rollers 41 only rotate during sheet feed to bring the contact portions 41*a* into contact with the sheet, and hence this configuration is less expensive than the configuration in which the loading plate 2 is elevated to bring the sheet loaded on the loading plate 2 into contact with the pickup rollers 41.

In addition, each of the pickup rollers 41 in the sheet feeding apparatus 1 according to the first embodiment has the shape of a roller having the contact portion 41*a* and the noncontact portion 41*b* in the rotational direction, and can switch the mode between contact and noncontact with the sheet on the loading plate 2 by making one revolution. Therefore, this configuration is less expensive than the configuration in which the mode is switched between contact and noncontact by moving the pickup rollers up and down without the noncontact portions.

The sheet feeding apparatus 1 increases the sheet conveying speed of the separation-and-conveyance roller pair 8 from the first conveying speed V1 to the second conveying speed V2 to allow sheet feeding intervals by the pickup rollers 41 to be shortened, thereby increasing the sheet feed rate.

The sheet feeding apparatus 1 according to the embodiment can increase the sheet feed rate without damaging the sheet or reducing the conveyance performance.

Moreover, the image forming apparatus 900 according to the embodiment includes the sheet feeding apparatus 1 having an increased sheet feed rate, thereby forming images on sheets with improved productivity.

(Sheet Feeding Apparatus 101 According to Second Embodiment)

Although the above-mentioned sheet feeding apparatus 1 according to the first embodiment is configured to rotate the pickup rollers 41 and the separation-and-conveyance roller pair 8 with the shared feed motor M1, a sheet feeding apparatus 101 according to a second embodiment is configured to rotate the pickup rollers 41 and the separation-and-conveyance roller pair 8 with separate motors, that is, a pickup motor M2 and a conveyance motor M3.

Figure 9:
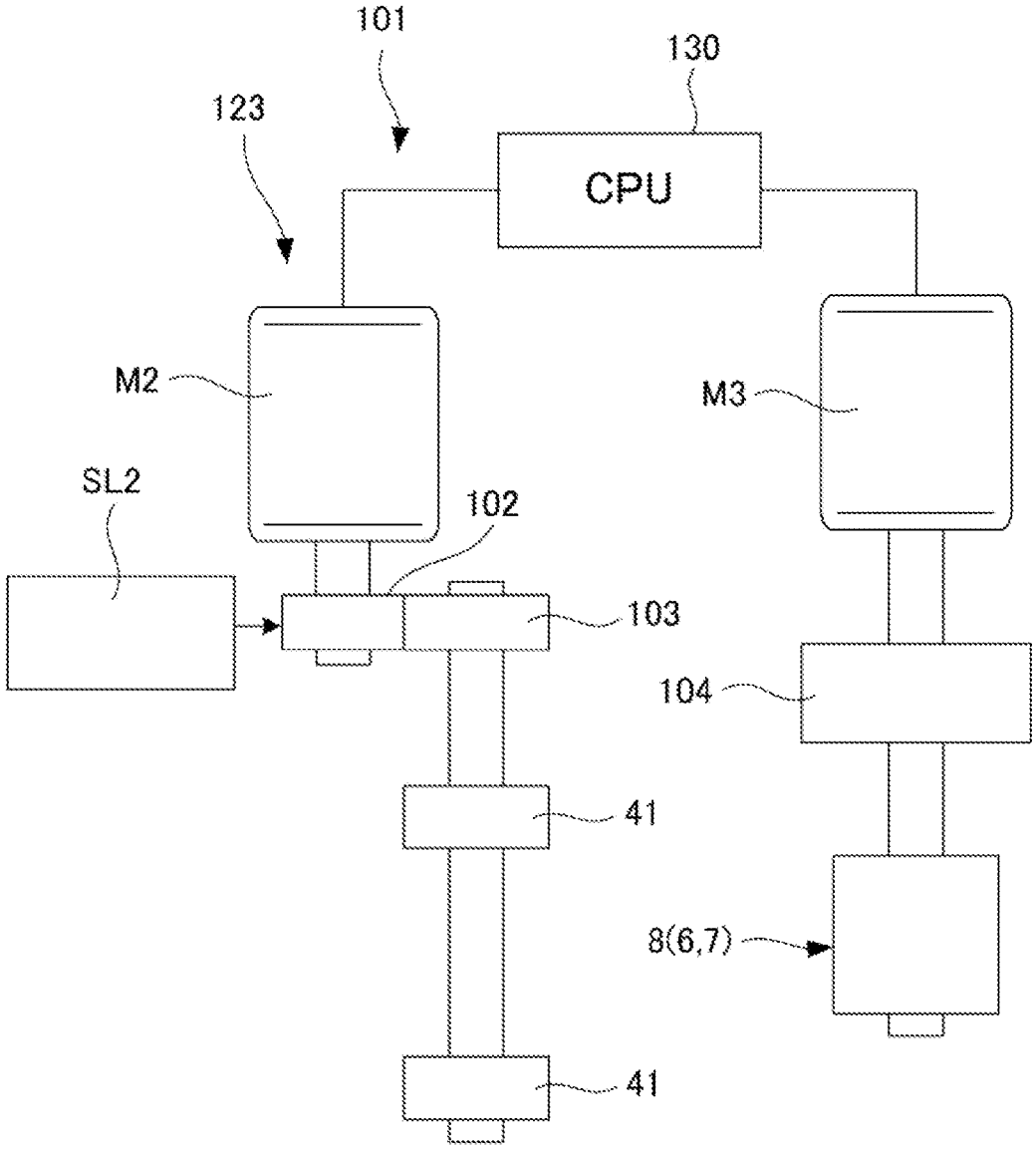
FIG. 9 is a view for illustrating a drive portion of a sheet feeding apparatus according to a second embodiment.
Figure 10:
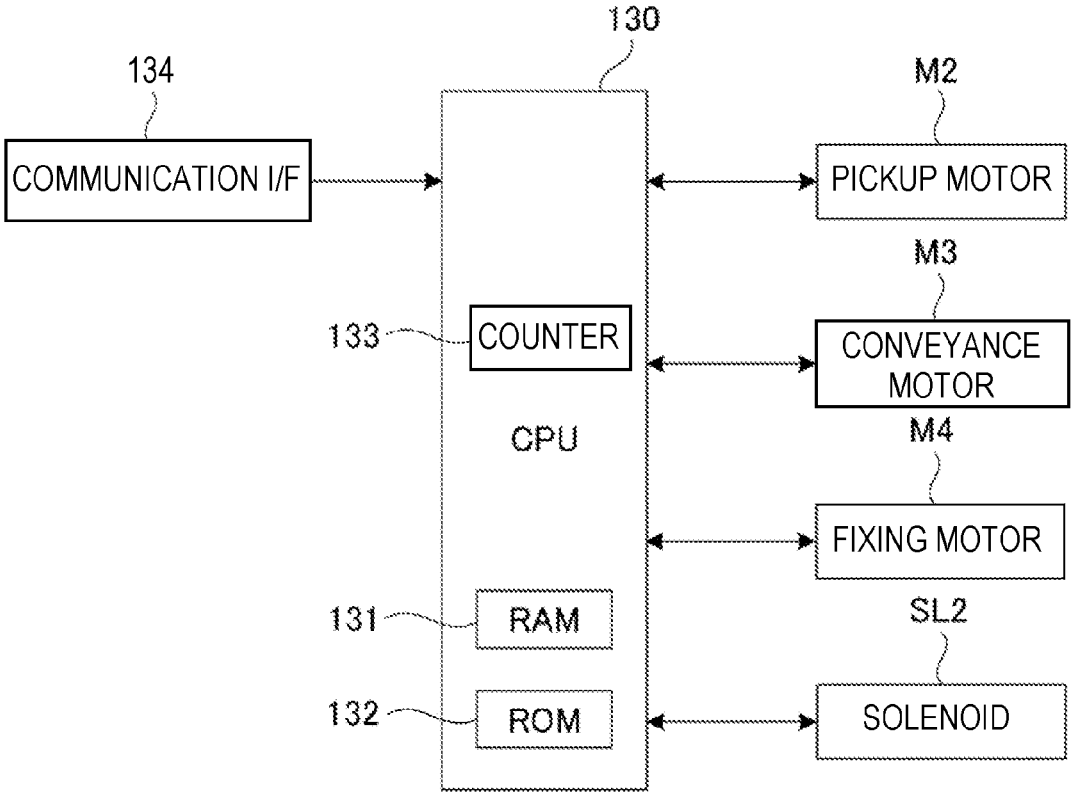
FIG. 10 is a block diagram of a control system of the sheet feeding apparatus of FIG. 9.
Figure 11:
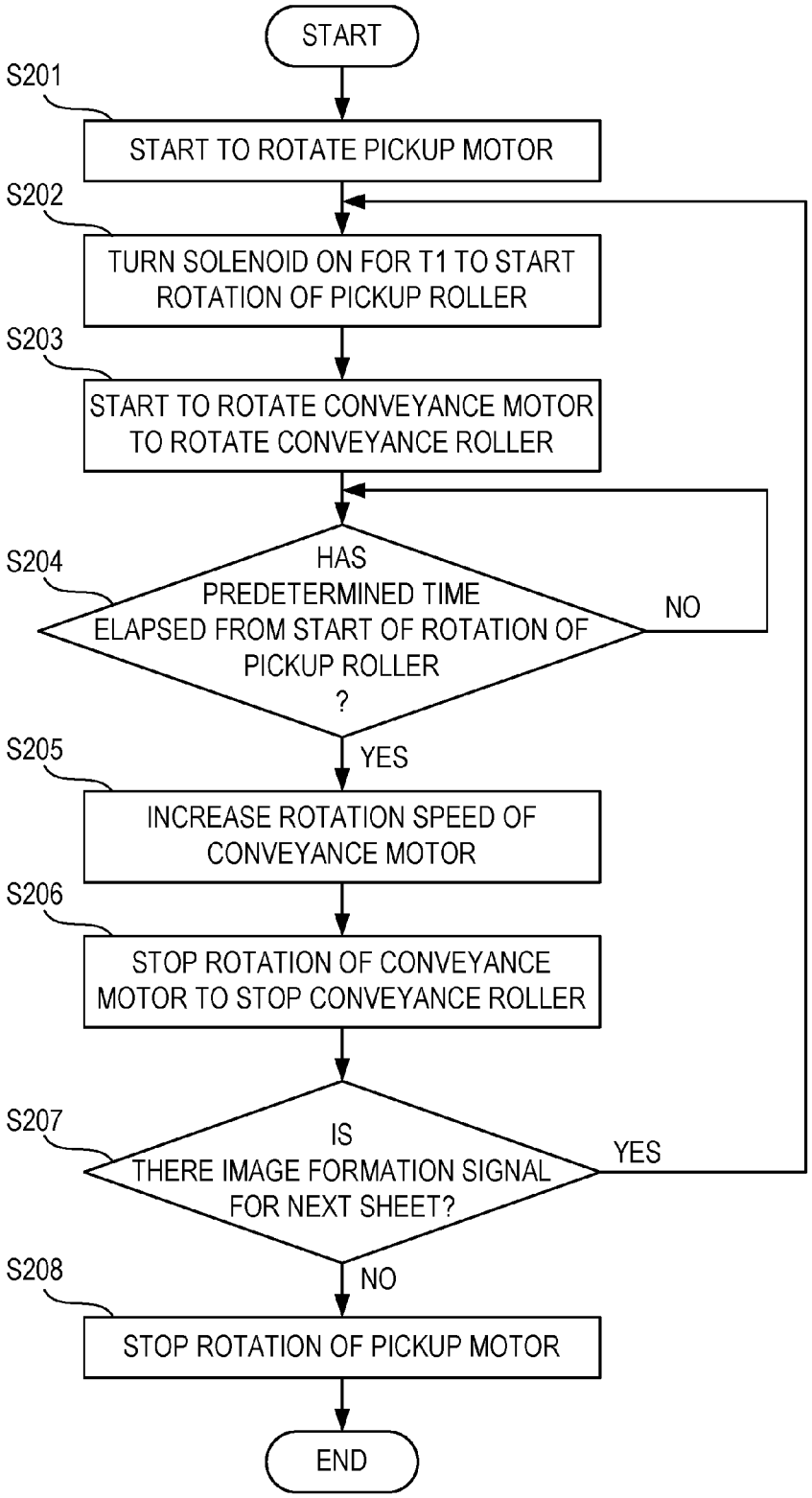
FIG. 11 is a flow chart for illustrating a control operation of the sheet feeding apparatus executed by a CPU.

FIG. 9 is a view for illustrating a drive portion 123 of the sheet feeding apparatus 101 according to the second embodiment. FIG. 10 is a block diagram of a control system of the sheet feeding apparatus 101 of FIG. 9. FIG. 11 is a flow chart for illustrating a control operation of the sheet feeding apparatus 101 executed by a CPU 130. The CPU 130 executes the control operation of the sheet feeding apparatus 101 in accordance with a program stored in a ROM 132. A sheet feed cassette according to the second embodiment has the same configuration as that of the sheet feed cassette 40 of the sheet feeding apparatus 1 according to the first embodiment, and hence its description is omitted. Semicircular pickup rollers and a separation-and-conveyance roller pair have the same shapes as those of the sheet feeding apparatus 1 according to the first embodiment, and hence are denoted by the same reference symbols and their description is omitted.

In FIG. 9, the semicircular pickup rollers 41 serving as a rotating feeder (feed unit) are configured to be rotated by the pickup motor M2 serving as a first drive source. The rotation is transmitted from the pickup motor M2 to the pickup rollers 41 by a pair of intermediate gears 102 and 103. A solenoid SL2 is operated to transmit the rotation from the pickup motor M2 to the intermediate gear 102. The separation-and-conveyance roller pair 8 serving as a conveyance unit is rotated by the conveyance motor M3 serving as a second drive source via a gear box 104. In the above-mentioned configuration, the pickup motor M2, the pair of the intermediate gears 102 and 103, the solenoid SL2, and the conveyance motor M3 construct the drive portion 123 serving as a drive unit.

In FIG. 10, the CPU 130 is configured to control the pickup motor M2, the conveyance motor M3, and the solenoid SL2 of the image forming apparatus 900. A RAM 131 is a work area of the CPU 130 and a temporary storage area of data. A firmware program for controlling the image forming apparatus 900 and a boot program for controlling the firmware program are written in the ROM 132 and used by the CPU 130. A counter 133 is configured to count a rotation time of the pickup rollers 41. A communication I/F 134 is connected to an external computer so that image data is transferred via the communication I/F 134. A DC motor or a stepping motor is used for the pickup motor M2 and the conveyance motor M3.

An operation of the sheet feeding apparatus 101 according to the second embodiment will be described. In FIG. 11, the CPU 130 causes the pickup motor M2 to rotate (Step S201). However, the CPU 130 does not turn on the solenoid SL2. Therefore, the rotation of the pickup motor M2 is not transmitted to the intermediate gear 102 so that the pickup rollers 41 do not rotate. Then, the number of revolutions of the pickup motor M2 is set to the number of revolutions that allows the pickup rollers 41 to have the sheet conveying speed V1 when the rotation is transmitted to the pickup rollers 41.

In this state, the CPU 130 turns on the solenoid SL2 for a time period of T1 seconds (Step S202). Then, the rotational force of the pickup motor M2 is transmitted to the pickup rollers 41 by the pair of the intermediate gears 102 and 103 to rotate the pickup rollers 41. The pickup rollers 41 feed the sheet from the sheet feed cassette. Then, the CPU 130 causes the conveyance motor M3 to rotate so that the conveyance roller 6 of the separation-and-conveyance roller pair 8 rotates (Step S203). In this step, the CPU 130 controls the rotation of the pickup motor M2 and the conveyance rollers M3 so that the sheet conveying speed of the pickup motors 41 and the sheet conveying speed of the conveyance roller 6 become the same sheet conveying speed V1.

The CPU 130 causes the counter 133 to count the rotation time of the pickup rollers 41 and determines that the noncontact portions 41*b* of the pickup rollers 41 face the sheet when a predetermined rotation time has elapsed (YES in Step S204). Then, the CPU 130 increases the rotation speed of the conveyance motor M3 so that the separation-and-conveyance roller pair 8 has the sheet conveying speed V2 (Step S205). The pickup rollers 41 are brought into a state of conveying no sheet, and the conveyance roller 6 conveys the sheet at the sheet conveying speed V2 (V2>V1) that is higher than the sheet conveying speed V1. When the conveyance roller 6 conveys the sheet at the sheet conveying speed V2 for a predetermined time period, the CPU 130 determines that the sheet has been conveyed adequately, to thereby stop the rotation of the conveyance motor M3 (Step S206). When there is a sheet to be fed in succession (YES in Step S207), the CPU 30 operates the solenoid SL2 again for the time period of T1 seconds to transmit the rotation of the pickup motor M2 to the pickup rollers 41. When there is no sheet to be fed in succession (NO in Step S207), the rotation of the pickup motor M2 is stopped (Step S208). Then, the pickup rollers 41 stop under a state in which the noncontact portions 41*b* face the sheet.

As described above, also in the sheet feeding apparatus 101 according to the second embodiment, the sheet conveying speed of the separation-and-conveyance roller pair 8 can be increased by the conveyance motor M3 while the noncontact portions 41*b* of the pickup rollers 41 face the sheet. Therefore, even when the sheet conveying speed of the separation-and-conveyance roller pair 8 is increased from V1 to V2, the sheet feeding apparatus 101 can prevent the pickup rollers 41 and the separation-and-conveyance roller pair 8 from being damaged while sheets neither have conveyance failure nor are pulled from both sides. The sheet feed rate can be prevented from being reduced due to damage to the pickup rollers 41 and the separation-and-conveyance roller pair 8. Moreover, the sheet feeding apparatus 101 can increase the sheet conveying speed of the separation-and-conveyance roller pair 8 from V1 to V2 to allow the sheet feeding intervals by the pickup rollers 41 to be shortened, thereby increasing the sheet feed rate.

Moreover, the sheet feeding apparatus 101 according to the second embodiment is configured to rotate the pickup rollers 41 and the separation-and-conveyance roller pair 8 through use of the separate motors M2 and M3, respectively. Therefore, when the noncontact portions 41*b* of the pickup rollers 41 face the sheet and the conveyance roller 6 conveys the sheet at the sheet conveying speed V2, the sheet feeding apparatus 101 can rotate the conveyance roller 6 at a higher rotation speed than that at the sheet conveying speed V1. Immediately after the trailing edge of the sheet being conveyed by the conveyance roller 6 at the sheet conveying speed V2 passes below the pickup rollers 41, the pickup rollers 41 can be thus turned into standby at a rotational position in which the next sheet can be conveyed with the contact portions 41*a* of the pickup rollers 41. Therefore, the intervals between the sheets can be reduced to further increase the sheet feed rate.

In addition, the sheet feeding apparatus 101 according to the second embodiment can feed sheets of various lengths by controlling the angle of rotation and the number of revolutions of the conveyance motor M3 in a state in which the pickup motor M2 is stopped.

The sheet feeding apparatus 101 according to the embodiment can increase the sheet feed rate without damaging the sheet or reducing the conveyance performance.

Moreover, the image forming apparatus 900 according to the embodiment includes the sheet feeding apparatus 101 having an increased sheet feed rate, thereby forming images on sheets with improved productivity.

In the above-mentioned embodiments, the pickup rollers 41 have the semicircular shape. However, the shape is not limited to the shape as long as the pickup rollers 41 are not always in contact with the sheet loaded on the loading plate 2.

The separation-and-conveyance roller pair 8 may not necessarily have the sheet conveying speed V1 equal to that of the pickup rollers 41 as long as the sheets and the separation-and-conveyance roller pair 8 are not damaged when the sheet conveying speed of the separation-and-conveyance roller pair 8 is set higher than that of the pickup rollers 41. Assuming that the sheet conveying speed of the pickup rollers 41 and the sheet conveying speed of the separation-and-conveyance roller pair 8 are represented by V1*a* and V1*b* (V1*b*>V1*a*), respectively, the sheet conveying speed of the separation-and-conveyance roller pair 8 is set to V2 which is higher than V1*b* when the pickup rollers 41 are not in contact with the sheet on the loading plate 2. Also in such a case, the sheet feed rate can be further increased to improve the productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-030576, filed Feb. 19, 2015, which is hereby incorporated by reference herein in its entirety.

What is claimed is:

1. A sheet feeding apparatus comprising:

a stacking unit on which a sheet is to be stacked;

a feed unit configured to assume a contact state in which the feed unit is in contact with a sheet stacked on the stacking unit and a noncontact state in which the feed unit is out of contact with a sheet stacked on the stacking unit, wherein the feeding unit turns into the noncontact state after the feeding unit feeds a sheet in the contact state;

a conveyance unit arranged downstream of the feed unit in a sheet feed direction and configured to convey a sheet fed by the feed unit;

a drive unit configured to drive the feed unit and the conveyance unit; and a transmission unit configured to transmit a drive force of the drive unit to the conveyance unit so that the conveyance unit conveys a sheet at a first conveying speed when the feed unit is in the contact state, and that the conveyance unit conveys a sheet at a second conveying speed which is higher than the first conveying speed when the feed unit is in the noncontact state.

2. A sheet feeding apparatus according to claim 1, wherein the drive unit is configured to drive the feed unit and the conveyance unit at the first conveying speed when the feed unit is in the contact state.

3. A sheet feeding apparatus according to claim 1, wherein the feed unit comprises: (1) a contact portion to be brought into contact with a sheet stacked on the stacking unit; (2) a noncontact portion kept out of contact with a sheet, the feed unit being configured to feed a sheet in the contact state in which the contact portion is in contact with the sheet, and then turn into the noncontact state in which the noncontact portion faces the sheet so as to be kept out of contact with the sheet; and (3) a rotary member having the contact portion and the noncontact portion arranged on an outer periphery in a rotation direction of the rotary member, and wherein the transmission unit is configured to rotate the rotary member from a pickup position in which the contact portion is in contact with a sheet stacked on the stacking unit to feed the sheet to a noncontact position in which the noncontact portion faces a sheet stacked on the stacking unit so as to be kept out of contact with the sheet.

4. A sheet feeding apparatus according to claim 1, wherein the feed unit comprises: (1) a contact portion to be brought into contact with a sheet stacked on the stacking unit; (2) a noncontact portion kept out of contact with a sheet, the feed unit being configured to feed a sheet in the contact state in which the contact portion is in contact with the sheet, and then turn into the noncontact state in which the noncontact portion faces the sheet so as to be kept out of contact with the sheet; and (3) a rotary member having the contact portion and the noncontact portion arranged on an outer periphery in a rotation direction of the rotary member, and wherein the sheet feeding apparatus further comprises a synchronization unit, which is configured to synchronize the feed unit with the conveyance unit so that a sheet conveying speed of the conveyance unit returns from the second conveying speed to the first conveying speed while the drive unit causes the rotary member to make one revolution.

5. A sheet feeding apparatus according to claim 1, wherein the feed unit comprises a pickup roller, wherein the conveyance unit comprises a conveyance roller pair configured to convey a sheet while nipping the sheet, wherein the transmission unit is arranged between the drive unit and the conveyance roller pair and configured to transmit a driving force of the drive unit to the conveyance roller pair, and wherein the transmission unit is configured to transmit the driving force of the drive unit to the conveyance roller pair so that a sheet conveying speed of the conveyance roller pair becomes the first conveying speed in the contact state in which the pickup roller is in contact with a sheet, and becomes the second conveying speed in the noncontact state in which the pickup roller is kept out of contact with a sheet.

6. An image forming apparatus comprising:

a sheet feeding apparatus; and an image forming portion configured to form an image on a sheet fed by the sheet feeding apparatus, wherein the sheet feeding apparatus comprises:

(a) a stacking unit on which a sheet is to be stacked;

(b) a feed unit configured to assume a contact state in which the feed unit is in contact with a sheet stacked on the stacking unit and a noncontact state in which the feed unit is out of contact with a sheet stacked on the stacking unit, wherein the feeding unit turns into the noncontact state after the feeding unit feeds a sheet in the contact state (c) a conveyance unit arranged downstream of the feed unit in a sheet feed direction and configured to convey a sheet fed by the feed unit;

(d) a drive unit configured to drive the feed unit and the conveyance unit; and (e) a transmission unit configured to transmit a drive force of the drive unit to the conveyance unit so that the conveyance unit conveys a sheet at a first conveying speed when the feed unit is in the contact state, and that the conveyance unit conveys a sheet at a second conveying speed which is higher than the first conveying speed when the feed unit is in the noncontact state.

* * * * *